US009540847B2

(12) United States Patent
Pena

(10) Patent No.: US 9,540,847 B2
(45) Date of Patent: Jan. 10, 2017

(54) MAGNETICALLY ENHANCED KEY AND LOCK SYSTEM

(71) Applicant: Rodolfo Pena, San Antonio, TX (US)

(72) Inventor: Rodolfo Pena, San Antonio, TX (US)

( * ) Notice: Subject to any disclaimer, the term of this patent is extended or adjusted under 35 U.S.C. 154(b) by 0 days.

(21) Appl. No.: 14/733,713

(22) Filed: Jun. 8, 2015

(65) Prior Publication Data

US 2015/0354247 A1 Dec. 10, 2015

Related U.S. Application Data

(60) Provisional application No. 62/008,879, filed on Jun. 6, 2014.

(51) Int. Cl.

| | |
|---|---|
| ***E05B 47/00*** | (2006.01) |
| ***E05B 21/00*** | (2006.01) |
| ***E05B 63/00*** | (2006.01) |
| ***E05B 65/00*** | (2006.01) |

(52) U.S. Cl.

CPC ..... *E05B 47/0045* (2013.01); *E05B 21/00* (2013.01); *E05B 47/0038* (2013.01); *E05B 63/0017* (2013.01); *E05B 65/0017* (2013.01); *Y10T 70/7672* (2015.04)

(58) Field of Classification Search

CPC ..... E05B 21/00; E05B 67/38; E05B 47/0038; E05B 47/0045; E05B 63/0017; E05B 65/0017; Y10T 70/7548; Y10T 70/7734; Y10T 70/7672; E05C 1/02

USPC ..... 70/353–355, 383, 384, 276, 413

See application file for complete search history.

(56) References Cited

U.S. PATENT DOCUMENTS

| | | | | | |
|---|---|---|---|---|---|
| 1,728,127 | A * | 9/1929 | Katz | E05B 35/125 | 70/339 |
| 3,727,439 | A * | 4/1973 | Parrock | E05B 21/00 | 70/355 |
| 4,507,944 | A * | 4/1985 | Widen | G07C 9/00722 | 70/276 |
| 4,526,022 | A * | 7/1985 | Parrock | E05B 35/083 | 70/339 |
| 4,562,711 | A * | 1/1986 | Fliege | G07C 9/00738 | 70/276 |
| 4,644,766 | A * | 2/1987 | Lovell | E05B 35/007 | 70/276 |
| 4,656,850 | A * | 4/1987 | Tabata | E05B 47/0673 | 292/144 |
| 4,656,852 | A * | 4/1987 | Deschamps | E05B 47/0607 | 70/277 |
| 4,807,455 | A * | 2/1989 | Mauer | E05B 47/0002 | 70/277 |

(Continued)

*Primary Examiner* — Suzanne Barrett
(74) *Attorney, Agent, or Firm* — Jackson Walker LLP

(57) ABSTRACT

The magnetic anti-tampering system of the magnetically enhanced key and lock system provides a mechanical and magnetic security system. It utilizes a modified paracentric key and a locking assembly affixed to a component inside of a paracentric lock. The magnetically enhanced key and lock system increases the security of a pair centric lock by defeating the unauthorized operation of pair centric locks by unauthorized users, such as inmates, who have fabricated copies of the authentic, paracentric keys. Paracentric locks and keys are the most common type of locks used in jails, state prisons, and detention facilities. The locking system requires that both the teeth of the key and the magnetic pairs of the key and locking dog combine to open the lock.

4 Claims, 5 Drawing Sheets

(56) References Cited

U.S. PATENT DOCUMENTS

| | | | | | |
|---|---|---|---|---|---|
| 4,984,441 | A * | 1/1991 | Mauer | E05B 47/0002 | 70/277 |
| 5,219,386 | A * | 6/1993 | Kletzmaier | E05B 17/147 | 70/277 |
| 5,485,733 | A * | 1/1996 | Hoffman | E05B 47/004 | 292/251.5 |
| 5,546,778 | A * | 8/1996 | Eisermann | E05B 35/083 | 70/276 |
| 5,878,610 | A * | 3/1999 | Friedrich | E05B 17/22 | 70/264 |
| 5,878,612 | A * | 3/1999 | Mauer | E05B 47/0002 | 292/150 |
| 5,890,384 | A * | 4/1999 | Bartel | E05B 81/64 | 70/264 |
| 6,006,561 | A * | 12/1999 | Hill | E05B 47/00 | 70/276 |
| 7,168,276 | B2 * | 1/2007 | Errani | E05B 47/0692 | 70/218 |
| 7,634,930 | B2 * | 12/2009 | Boesel | E05B 29/00 | 70/383 |
| 8,938,998 | B2 * | 1/2015 | Haber | E05B 47/0038 | 292/251.5 |
| 2015/0354247 | A1 * | 12/2015 | Pena | E05B 47/0045 | 70/373 |

* cited by examiner

MAGNETICALLY ENHANCED KEY AND LOCK SYSTEM

This application is based upon and claims priority from U.S. Provisional application Ser. No. 62/008,879, which is incorporated herein by reference.

BACKGROUND OF THE INVENTION

Field of the Invention

Applicants' invention relates to a device for magnetic anti-tampering system. More particularly, it relates to magnetically paired keys and locks that use lever tumblers.

Background Information

There are many keys for many different types of locks. One type of lock and key commonly used in prisons and correctional facilities is the paracentric. Paracentric literally means to deviate from circularity, or changing the distance from a center. A paracentric key is distinguishable by the heavily contoured shape of its blade, which protrudes past the center vertical line of the keyway in the cylinder. Locks with paracentric keyways offer a higher level of protection against picking since they prevent direct access to the pins by traditional picking tools. A paracentric lock has a keyway with one or more wards on each side projecting beyond the vertical center line of the keyway. Instead of the wards on the outer face of the lock simply protruding into the shape of the key along the spine, the wards protrude into the shape of the key along the entire width of the key, including along the length of the teeth. The shape and wards of the paracentric lock and key are designed to hinder picking. This is the reason that person could locks and keys are often used in jails. However, even the paracentric lock and keys are not completely immune to picking by motivated individuals such as inmates.

A pin tumbler lock is a lock mechanism that uses pins of varying lengths to prevent the lock from opening without the correct key. Pin tumblers are most commonly employed in cylinder locks, but may also be found in other types of locks as well.

Pin tumbler locks are made up of a Bible which sits around a cylindrical plug. Unimpeded, the plug will rotate inside the Bible. The Bible of the lock contains the springs and the driver pins. The driver pins sit between the Bible and the plug of the lock. The plug is the portion of the lock that contains the keyway and will turn when the correct key is inserted. Below the driver pins are the key pins. The key pins will actually touch the key when it is inserted. The driver pins and the key pins are in contact and a thought one another but are not connected. All of the pins slide within a cylinder with the springs urging the pins down. The driver pins and springs are all the same length. In contrast, each of the key pins has a unique length that corresponds to the unique cuts (teeth) in the key. When no key is in the keyway, the springs urge the driver pins past the junction of the Bible and plug, thus the driver pins block rotation of the plug. If an incorrect key is inserted into the lock, then the lock teeth will either be too short or too tall. If a key tooth is too big, then the driver pin/lock pin combination is moved against the spring such that the lock pin extends beyond the junction of the Bible and plug and the lock pin blocks rotation of the plug. If a key tooth is too small, then like when there is no key at all, the spring urges the lock pin past the junction of the Bible and plug again blocking rotation of the plug. Of the Bible and plug is called the sheer line. When the correct key is inserted into the lock, the key pins are raised by the teeth such that the top of the key pins and the bottom of the driver pins sit at the sheer line. This allows the plug to rotate and disengage the lock.

In contrast to the pin tumblers, a lever tumbler lock is a type of lock that uses a set of levers (instead of pins) to prevent the bolt from moving in the lock. In the simplest of these, lifting the tumbler above a certain height will allow the bolt to slide past. In a double acting lever lock a slot is cut in the lever so that the lever must be lifted to a certain height but not too far in order for the bolt to be allowed to move within the lock. The number of levers may vary, and may be increased in order to provide correspondingly increased levels of security.

In the past, magnetic keys have been used with pin tumbler type locks. A magnetic-coded lock uses pins in combination with magnets to prevent unlocking with non-matching keys by teething and magnetic polarity. Magnetic locks/keys use paired magnets with opposing poles inside the key and plug. When a correctly matched key is inserted into the lock, not only are all the mechanical pins pushed into the correct positions, the magnetic pins are also driven to the appropriate level by the magnetic force inside the key. Magnetic-coded locks offer heightened security because in order to unlock a lock not only must the key teething fit with the pins, the magnetic pin locations and poles of the lock and key must correspond. The correct fitting position can be found by feeling the effect of the magnetic force, or by aligning with the markings. When the magnetic key is placed on a magnetic lock, the lock magnets online the magnetic catches arranged in a freely rotatable manner in relation to the key magnets such that the opposite poles oppose each other. Further, the lock magnets are pulled by the key magnets into locked positions. This occurs because the attractive force acting between the lock magnets and the key magnets is slightly greater in the online edition and the attractive force acting between the lock. If there is no magnetic key or respectively corresponding external magnetic force, the magnetic attraction of the key magnets combined so that the magnetic catches independently pull themselves into the locked position. This is in addition to the spring mechanisms of the pin tumbler locks.

SUMMARY OF THE INVENTION

The present invention incorporates magnets into lever tumbler and paracentric locks.

The present invention provides a novel apparatus that will increase the difficulty in picking a lever tumbler, paracentric lock.

The magnetic anti-tampering system of the present invention provides a mechanical and magnetic security system. It utilizes a modified paracentric key and a locking assembly affixed to a component inside of a paracentric lock. The present invention increases the security of a pair centric lock by defeating the unauthorized operation of pair centric locks by unauthorized users, such as inmates, who have fabricated copies of the authentic, paracentric keys. Paracentric locks and keys are the most common type of locks used in jails, state prisons, and detention facilities. Thus, the present invention is particularly adapted for prison and correctional facility door locks.

DETAILED DESCRIPTION OF THE PREFERRED EMBODIMENT

Figure 1:
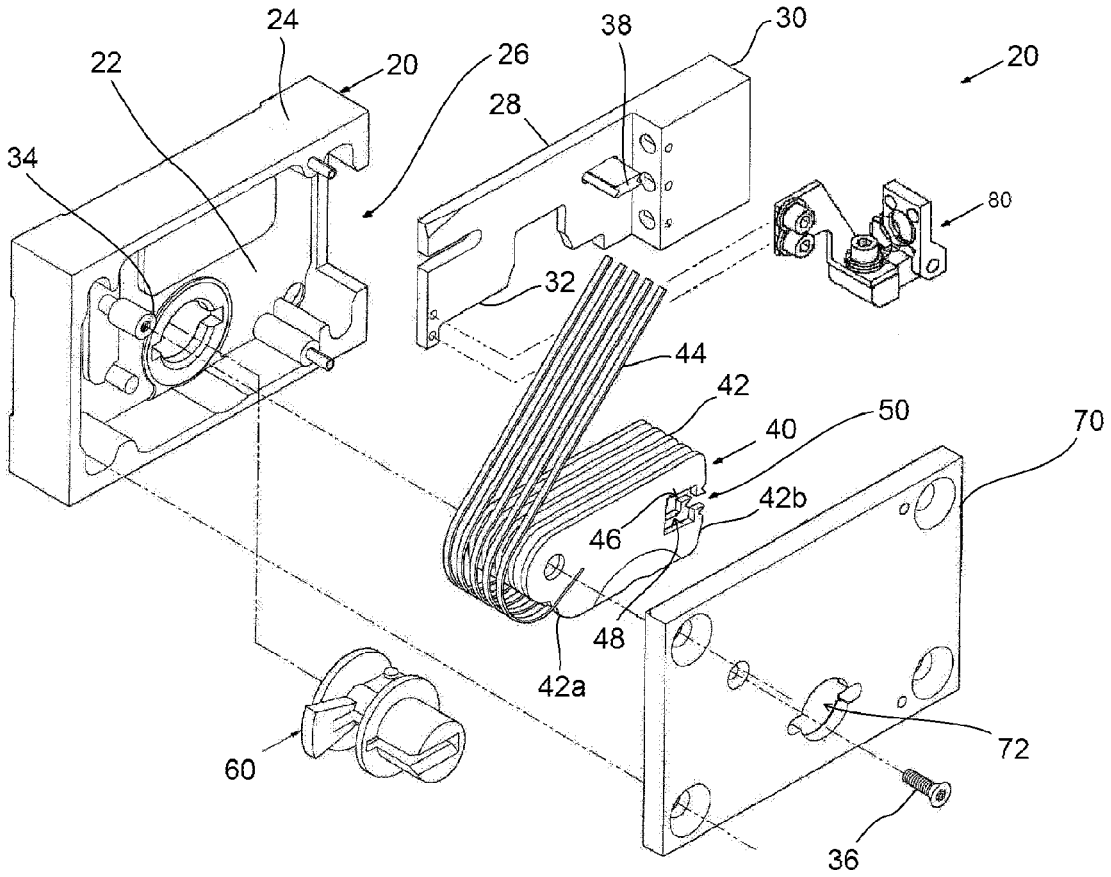
FIG. 1 is a perspective, exploded view of lever tumbler lock.

Referring to the figures, FIG. 1 illustrates the parts of a lever tumbler, magnetic paracentric lock 10. The magnetic paracentric lock 10 has a lock case 20 that has a generally hollow interior. The lock case 20 has a back 22 and sides 24 that enclose most of the sides of the lever tumbler lock 10. The lock case 20 has attachment apertures 34 in the back 22 that allow the lever tumbler lock 10 to be attached to a wall or door using fasteners 36, such as screws, bolts, welds, or other attachment means as are well-known in the industry.

The lock case 20 has a bolt aperture 26 that is sized to allow a lock bolt 28 to slide through. The lock bolt 28 has an engagement end 30 and a locking end 32. The engagement end 30 is generally thicker than the locking end 32. The engagement end 30 is sized to slide through the bolt aperture 26. Ideally, the tolerance between the engagement end 30 and the bolt aperture 26 is kept to a minimum. The locking end 32 has a horizontal rail 38 attached that extends generally perpendicularly to the lock bolt 28.

A tumbler set 40 is also rotatably attached in the interior of the lock case 20. The tumbler set 40 is comprised of a multiplicity of levers 42. Each lever 42 is generally rectangularly shaped with a first end 42*a* that is rotatably attached to the interior of the lock case 20. The first end 42 a is also attached to a spring mechanism 44 that when engaged with the interior of a lock case 20 side 24, tends to urge the second end 42*b* of the lever 42 toward a locked position. The second end 42*b* has and activation cutout 46 that has a channel 50 through the front of the second end 42*b* that is sized to allow the horizontal rail 38 to move horizontally through the activation cutout 46 and channel 50, consequently allowing the lock bolt 28 to slide through the bolt aperture 26 so as to lock or unlock the subject door. Interior to the activation cutout 46 is a stop cutout 48 that is sized to allow the horizontal rail 38 to move vertically to a position away from the channel 50.

Thus, if a lever 42 is raised too high, or lowered too low, then the channel 50 will not line up with the horizontal rail 38 and the stop cutout 48 holds the lock bolt 28 from sliding through the bolt aperture 26. If all of these levers 42 are set to the correct position (presumably by the teeth of a key 100) then the horizontal rail 38 will line up with the channel 50 allowing the lock bolt 28 to slide through the bolt aperture 26.

Mechanically engaged with the tumbler set 40 is a key cylinder 60. The key cylinder 60 works similarly to the pin tumbler lock with the Bible and plug as described above except that instead of moving the pins, a key 100 turns and its teeth act to position the levers 42.

The lock bolt 28, tumbler set 40, and key cylinder 60 are enclosed in the interior of the lock case 20 by a lock cover 70 which is attached by fasteners 36 to the lock case 20. The lock cover 70 has a key aperture 72 that allows access with a key 100 to the key cylinder 60. The key aperture 72 may be shaped and sized in order to admit a paracentric key 100.

Figure 2:
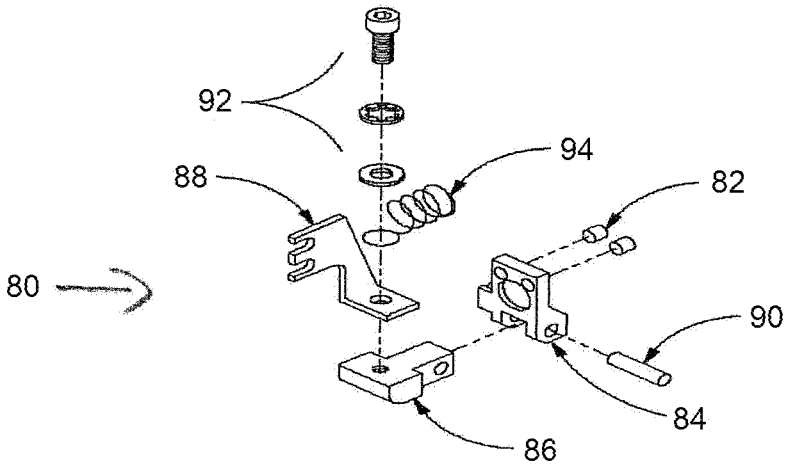
FIG. 2 is a perspective, exploded view of the locking assembly.

FIG. 2 shows an exploded view of the magnetic locking assembly 80. The magnetic locking assembly 80 also fits in the interior of the lock case 20. The magnetic locking assembly 80 is comprised of magnets 82. These magnets 82 are anticipated to be neodymium type magnets, but are not required to be. "Neodymium" refers to magnets that are a type of rare-earth magnet. They are considered a permanent magnet made for the alloy of neodymium, iron, and boron. Permanent magnets are those made from materials that are magnetized and create their own persistent magnetic fields. The neodymium magnets 82 are embedded in a locking dog 84. The locking dog 84 is attached to a locking carriage 86 by means of a pin or second fastener 90. A connecting bracket 88 is connected to the locking carriage 86 opposite from the locking dog 84. A third fastener 92 connects the connecting bracket 88 and locking carriage 86 to the lock bolt 28 in the interior of the lock case 20. The locking assembly 80 holds the neodymium magnets 82 in magnetic communication with a magnetic key 100 inserted into the key cylinder 60. The pin or second fastener 90 may be a hardened steel pin. The pin or second fastener 90 allows the locking dog 84 to rotate or rock while connected to the locking carriage 86. A compression spring 94 is secured to the locking carriage 86 by the third fastener 92.

Figure 3A:
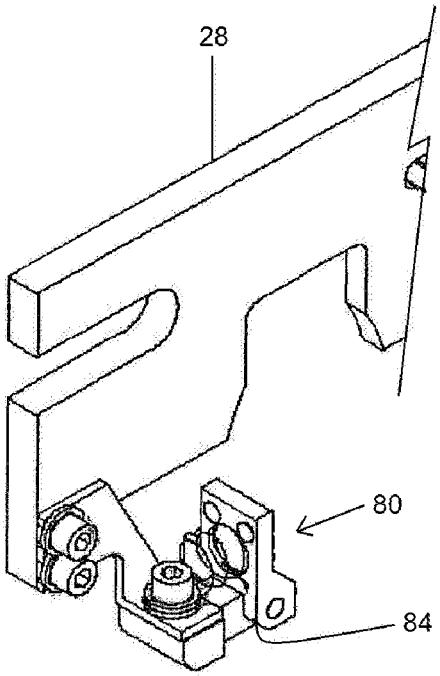
FIG. 3*a* is a perspective view of the locking assembly attached to the lock bolt.

FIG. 3*a* shows the positioning of the locking assembly 80 attached to the lock bolt 28.

Figure 3B:
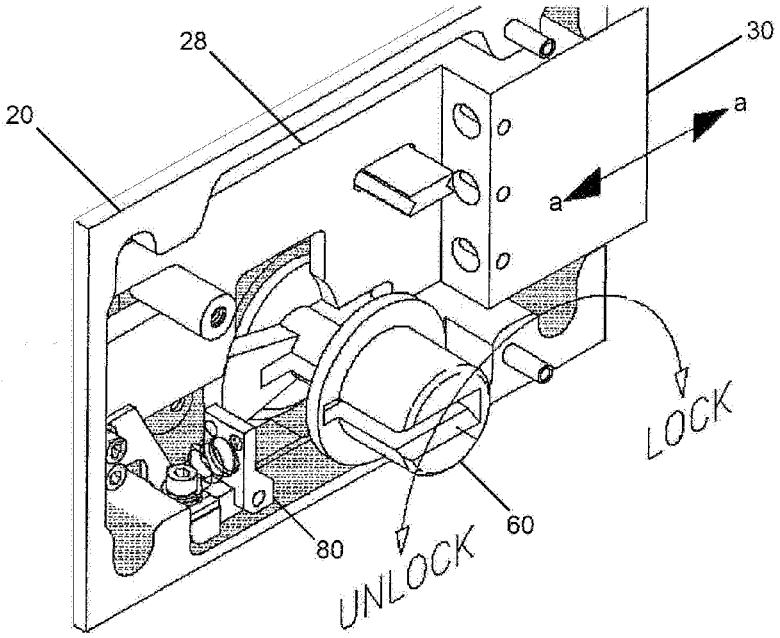
FIG. 3*b* is a perspective, cutaway view of the carriage assembly illustrating the locked position.

FIG. 3*b* illustrates how the connecting bracket 88 allows the locking assembly 80 to move in a linear motion with the lock bolt 28 as the key cylinder 60 rotates. The compression spring 94 is positioned such that it maintains constant positive pressure on the locking dog 84 and keeping the key cylinder 60 in the locked position until unlocked with the correct magnified key 100.

Figure 4:
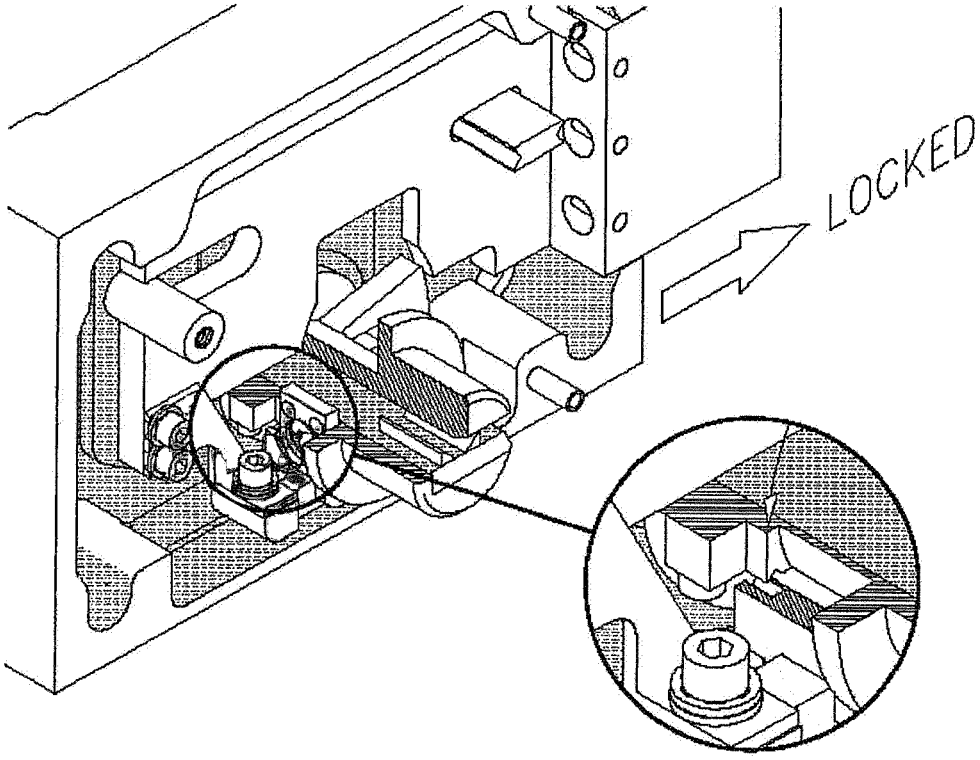
FIG. 4 is a perspective, cutaway view of the carriage assembly illustrating the unlocked position.

FIG. 4 illustrates how when the locking dog 84 is moved to the unlocked position by use of a magnetized paracentric key 100, the key cylinder 60 is allowed to rotate and unlock the lock.

Figure 5:
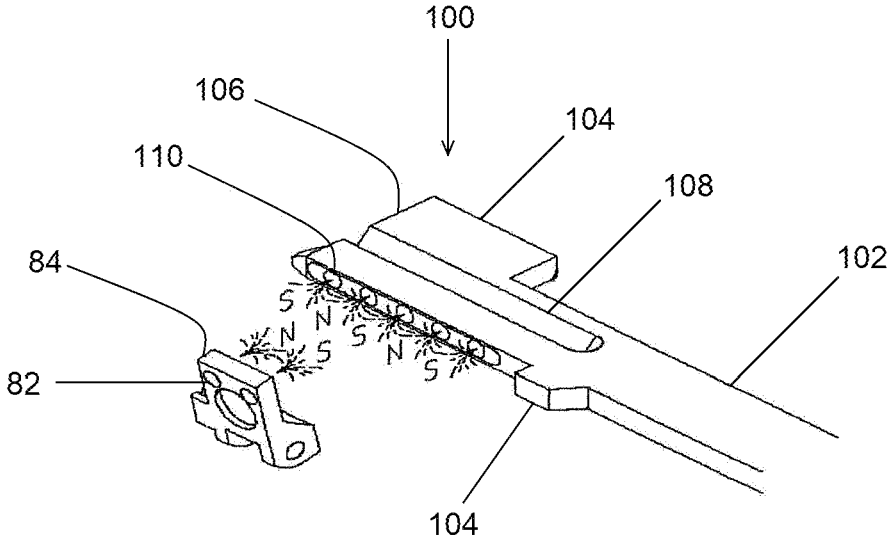
FIG. 5 is a perspective view of a paracentric key with embedded magnets.

FIG. 5 illustrates a portion of a magnetic paracentric key 100. The basic parts of a key include a head or bow which provide a portion of the key for the user to hold, a shank or blade across which are the millings, grooves, bits, teeth and the like that are specific for a lock, a at the junction of the bow and blade controls how much of the blade will enter a lock, and the tip at the opposite end of the shank from the bow. In FIG. 5, a portion of the shank 102 is illustrated with bits 104 and groove 108 that can be made specific for an individual paracentric key cylinder 60. In order to make the magnetic paracentric key 100 specific to a magnetic paracentric lock 10, key magnets 110 are embedded in the shank 102 of the magnetic paracentric key 100. As with the magnets 82 embedded in the locking dog 84, the key magnets 110 are anticipated, but not required, to be neodymium type, permanent magnets. The key magnets 110 are embedded in predetermined locations along the shank 102 in the area between the key stop (not shown) to the tip 106. The key magnets 110 are inserted in order that one of their two (2) magnetic poles is exposed at the surface of the shank 102. The number of magnets 82 and key magnets 110 may vary, but generally is anticipated that there will be at least three (3) magnet 82/key magnet 110 pairs. The magnet 82/key magnet 110 pairs are generally paired and positioned such that the adjoining poles of the pairs are the same polarity—repelling each other. While fewer pairs could be used if the magnets were of sufficient strength, it is desirable to use a multiplicity of pairs to increase the interaction between the magnet pairs as well as making a legitimate copy of the magnetic paracentric key 100 more difficult. It is anticipated that there may be more key magnets 110 embedded in the magnetic paracentric key 100 and there are magnets 82 embedded in the locking dog 84. The paired magnets—those that are involved in repelling the locking dog 84 to the unlocked position—are referred to as "active magnets" and those that are not are referred to as "passive magnets." Once the active magnets of a magnetic paracentric key 100 are fully inserted into a paired magnetic paracentric lock 10, the active key magnets 110 align with the magnets 82 embedded in the locking dog 84, thus paired the locking dog 84 will be repelled against the urging of the spring 94 and moved to the unlocked position. When the locking dog 84 is in the unlocked position the key 100 and key cylinder 60 are allowed to rotate and unlock the lock 10. When the correct, active key magnets 110 are not inserted with the key 100 in the key cylinder 60, the spring 94 urges the locking dog 84 against the key cylinder 60 keeping it from rotating and unlocking the lock 10. Thus, even if a key with its teeth, bits and grooves is otherwise shaped correctly, it will not turn the key cylinder 60 if the magnets 82 and active key magnets 110 are not positioned and paired correctly. The order of the magnetic poles expose along the shank 102 of the key 100 is referred to as the magnetic sequence combination. This design feature allows for multiple magnetic sequence combinations for keys with the same keyway (lateral grooves) and combination (key cuts). In a prison setting where the present invention is anticipated to be employed the magnetic pairs and sequence can frustrate an inmate who otherwise might be able to illegally duplicate the physical shape of the key 100.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A magnetic, anti-tampering locking device comprising:

a lock comprising a case with a generally hollow interior and a tumbler set inside of side hollow case;

said case attached to a wall or a door;

said case having a bolt aperture;

a lock bolt sized to slide through said bolt aperture;

a tumbler set having a multiplicity of levers, wherein said tumbler set is rotatably attached in the interior of said case and wherein if a lever is not positioned correctly said lock bolt is held from sliding through said bolt aperture;

a key cylinder mechanically engaged with said tumbler set;

a key having teeth, wherein said key is insertable into said key cylinder and wherein if the key is turned the key's teeth act to position the levers;

a locking assembly inside of said case, said locking assembly further comprising a carriage and a locking dog;

said locking dog rotatably attached to said carriage, and wherein said locking dog has a multiplicity of locking dog magnets attached;

a compression spring positioned such that said compression spring maintains constant positive pressure on said locking dog such that said locking dog holds said key cylinder in a locked position; said key further comprised of a multiplicity of key magnets said key magnets being paired with said locking dog magnets, and wherein said poles of said pairs are of the same polarity;

wherein the repellent power of said magnet pairs sufficient to rotate said locking dog against said compression spring allowing said key cylinder to move to an unlocked position; and wherein in order to unlock said locking device said key teeth must position said levers in a given position and said magnet pairs must rotate said locking dog.

2. The magnetic, anti-tampering locking device comprising of claim 1, wherein said locking dog magnets and said key magnets are neodymium type magnets.

3. The magnetic, anti-tampering locking device comprising of claim 1, wherein said locking dog magnets are embedded in said locking dog and said key magnets are embedded in said key.

4. The magnetic, anti-tampering locking device comprising of claim 1, wherein there are a greater number of said key magnets than said locking dog magnets, and wherein only those key magnets that pair with said locking dog magnets act to rotate said locking dog.

* * * * *